US009879679B2

(12) United States Patent
Lee et al.

(10) Patent No.: US 9,879,679 B2
(45) Date of Patent: Jan. 30, 2018

(54) SCROLL COMPRESSOR

(71) Applicant: LG Electronics Inc., Seoul (KR)

(72) Inventors: Jaesang Lee, Seoul (KR); Kangwook Lee, Seoul (KR); Inho Won, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 444 days.

(21) Appl. No.: 14/283,187

(22) Filed: May 20, 2014

(65) Prior Publication Data

US 2014/0348680 A1 Nov. 27, 2014

(30) Foreign Application Priority Data

May 21, 2013 (KR) ..... 10-2013-0057321

(51) Int. Cl.
*F04C 29/12* (2006.01)
*F04C 23/00* (2006.01)
*F04C 18/02* (2006.01)

(52) U.S. Cl.
CPC ..... *F04C 29/12* (2013.01); *F04C 18/0215* (2013.01); *F04C 18/0261* (2013.01); *F04C 23/008* (2013.01)

(58) Field of Classification Search
CPC ..... F04C 18/0215; F04C 18/0261; F04C 23/008; F04C 29/12; F04C 29/028
USPC ..... 418/55.2, 55.6
See application file for complete search history.

(56) References Cited

U.S. PATENT DOCUMENTS 6,030,192 A * 2/2000 Hill ..... F04C 18/0215 418/55.2
2006/0216182 A1* 9/2006 Kohsokabe ..... F04C 29/028 418/55.6
2013/0089449 A1 4/2013 Seong et al.

FOREIGN PATENT DOCUMENTS

CN 101089395 12/2007

OTHER PUBLICATIONS

Chinese Office Action dated Dec. 2, 2015.
Chinese Office Action dated Jul. 22, 2016 issued in Application No. 201410215127.5 (with English Translation).

* cited by examiner

*Primary Examiner* — Mark Laurenzi
*Assistant Examiner* — Paul Thiede
(74) *Attorney, Agent, or Firm* — KED & Associates, LLP

(57) ABSTRACT

A scroll compressor is provided, in which a fixed side discharge opening is formed eccentric from a geometrical center of an orbiting scroll toward an orbiting side discharge opening, so as to overlap the orbiting side discharge opening across a relatively wide area. This may reduce flow resistance between the orbiting side discharge opening and the fixed side discharge opening. Accordingly, a refrigerant compressed in a final compression chamber may be rapidly discharged without being blocked by an upper frame, while maintaining a proper discharge pressure. Since uniform pressure may be maintained in compression chambers positioned at both sides of the scroll compressor, input losses due to over-compression may be reduced.

7 Claims, 7 Drawing Sheets

SCROLL COMPRESSOR

CROSS-REFERENCE TO RELATED APPLICATION(S)

This application claims priority under 35 U.S.C. § 119 to Korean Application No. 10-2013-0057321, filed on May 21, 2013, whose entire disclosure is hereby incorporated by reference.

BACKGROUND

Field

This relates to a scroll compressor.

Background

A scroll compressor may suction and compress a refrigerant with an orbiting scroll performs an orbital motion with respect to a fixed scroll, with a fixed wrap of the fixed scroll engaged with an orbital wrap of the orbiting scroll. In this case, a compression chamber including a suction chamber, an intermediate pressure chamber and a discharge chamber may move consecutively between the fixed wrap and the orbital wrap.

Such a scroll compressor may generate reduced vibration and noise, since a suction process, a compression process and a discharge process are performed consecutively.

BRIEF DESCRIPTION OF THE DRAWINGS

The embodiments will be described in detail with reference to the following drawings in which like reference numerals refer to like elements wherein.

DETAILED DESCRIPTION

Description will now be given in detail of exemplary embodiments, with reference to the accompanying drawings. For the sake of brief description with reference to the drawings, the same or equivalent components will be provided with the same reference numbers, and description thereof will not be repeated.

Behavior characteristics of a scroll compressor may be determined by a type of a fixed wrap and an orbital wrap. The fixed wrap and the orbital wrap may have any shape. However, in many scroll compressors the fixed wrap and the orbital wrap have an involute curve form which may be easily processed. Such an involute curve has a path formed by the end of a string when the string wound on a basic circle having an arbitrary radius is unwound. When applying using such an involute curve form, a capacity change rate may constant because the thickness of the wrap is constant. For a high compression ratio, the number of turns of the wrap may be increased. However, this may also cause the size of the scroll compressor to increase.

In the orbiting scroll, an orbital wrap is formed at a first side surface of a disc shaped plate formed. A boss portion is formed on a second side surface of the plate where the orbital wrap has not been formed, and is connected to a rotation shaft which drives the orbiting scroll to perform an orbital motion. In this arrangement, a diameter of the plate may be reduced, because the orbital wrap is formed on almost the entire area of the plate. However, a point of application to which a repulsive force of a refrigerant is applied during a compression operation, and a point of application to which a reaction force to attenuate the repulsive force is applied, may be spaced apart from each other in a vertical direction, which may cause unstable behavior of the orbiting scroll during the operation, resulting in severe vibration or noise.

Figure 1:
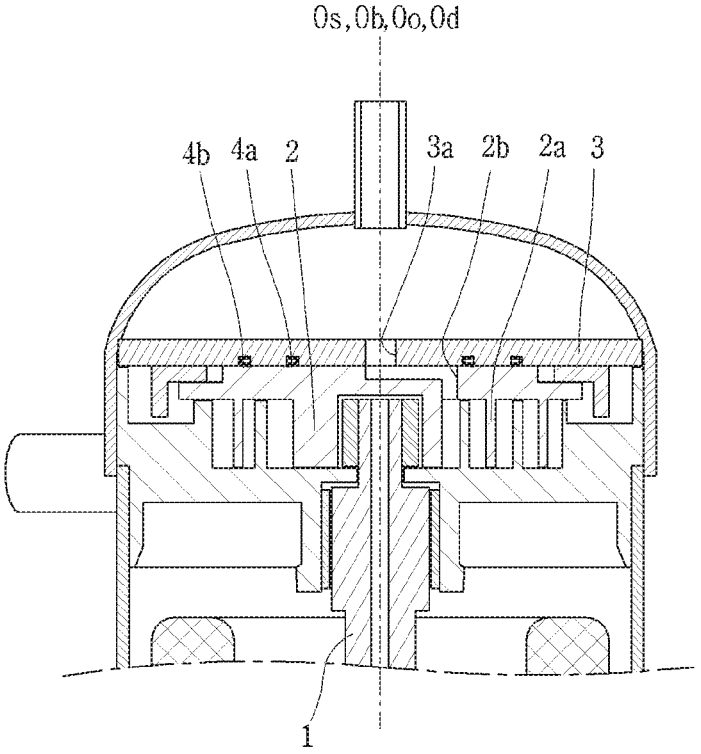
FIG. 1 is a longitudinal sectional view of a compression part of an scroll compressor in accordance with an exemplary embodiment.
Figure 2:
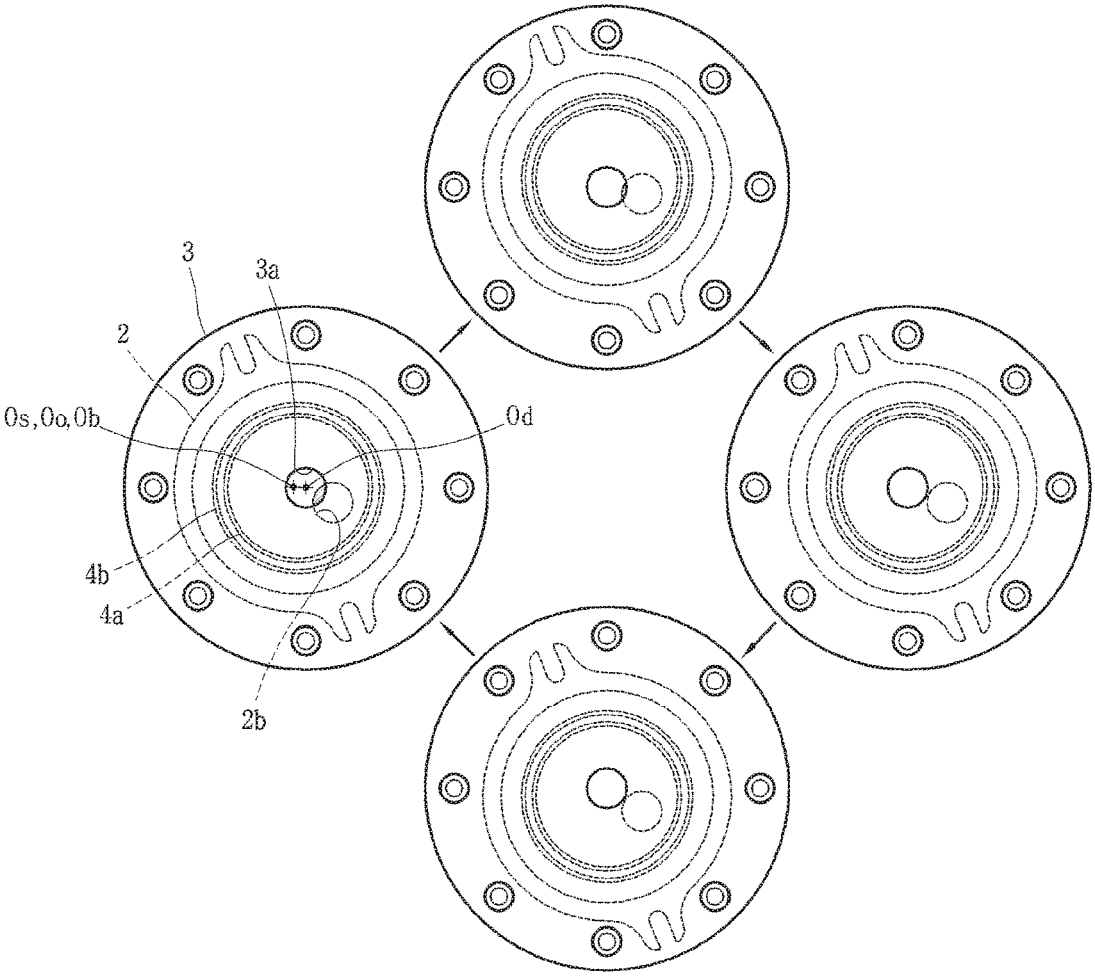
FIG. 2 is a planar view illustrating relative positions of a fixed side discharge opening and an orbiting side discharge opening, based on an orbital path of an orbiting scroll of the exemplary scroll compressor shown in FIG. 1.

In an exemplary scroll compressor as shown in FIG. 1, a coupling point between a rotation shaft 1 and an orbiting scroll 2 is formed on the same surface as an orbital wrap 2*a*. In such scroll compressor, since a point of application to which a repulsive force of a refrigerant is applied, and a point of application to which a reaction force to attenuate the repulsive force is applied, are the same, a tilting phenomenon of the orbiting scroll 2 may be solved.

However, such a scroll compressor may have lowered compression efficiency, even if an orbiting side discharge opening 2*b* of the orbiting scroll 2 is formed to be eccentric from a geometrical center (Oo) of the orbiting scroll 2. More specifically, a fixed side discharge opening 3*a* of an upper frame 3, which is installed on a rear surface of the orbiting scroll 2, is formed at the center of the upper frame 3. As a result, over-compression may occur while a refrigerant discharged from the orbiting side discharge opening 2*b* is guided to the fixed side discharge opening 3*a*. That is, since sealing members 4*a*, 4*b* forming a back pressure chamber are installed between the orbiting scroll 2 and the upper frame 3, the fixed side discharge opening 3*a* is formed at the center of the upper frame 3 as shown in FIG. 1. Therefore, an overlap area between the fixed side discharge opening 3*a* and the orbiting side discharge opening 2*b* becomes narrow. Thus a refrigerant discharged from the orbiting side discharge opening 2*b* is discharged to the fixed side discharge opening 3*a*, after being blocked near the fixed side discharge opening 3*a* of the upper frame 3. This may increase flow resistance between the orbiting side discharge opening 2*b* and the fixed side discharge opening 3*a*, and may cause over-compression in a corresponding compression chamber, lowering overall compression efficiency.

Hereinafter, a scroll compressor, in accordance with embodiments as broadly described herein, will be explained in more detail with reference to the attached drawings.

Figure 3:
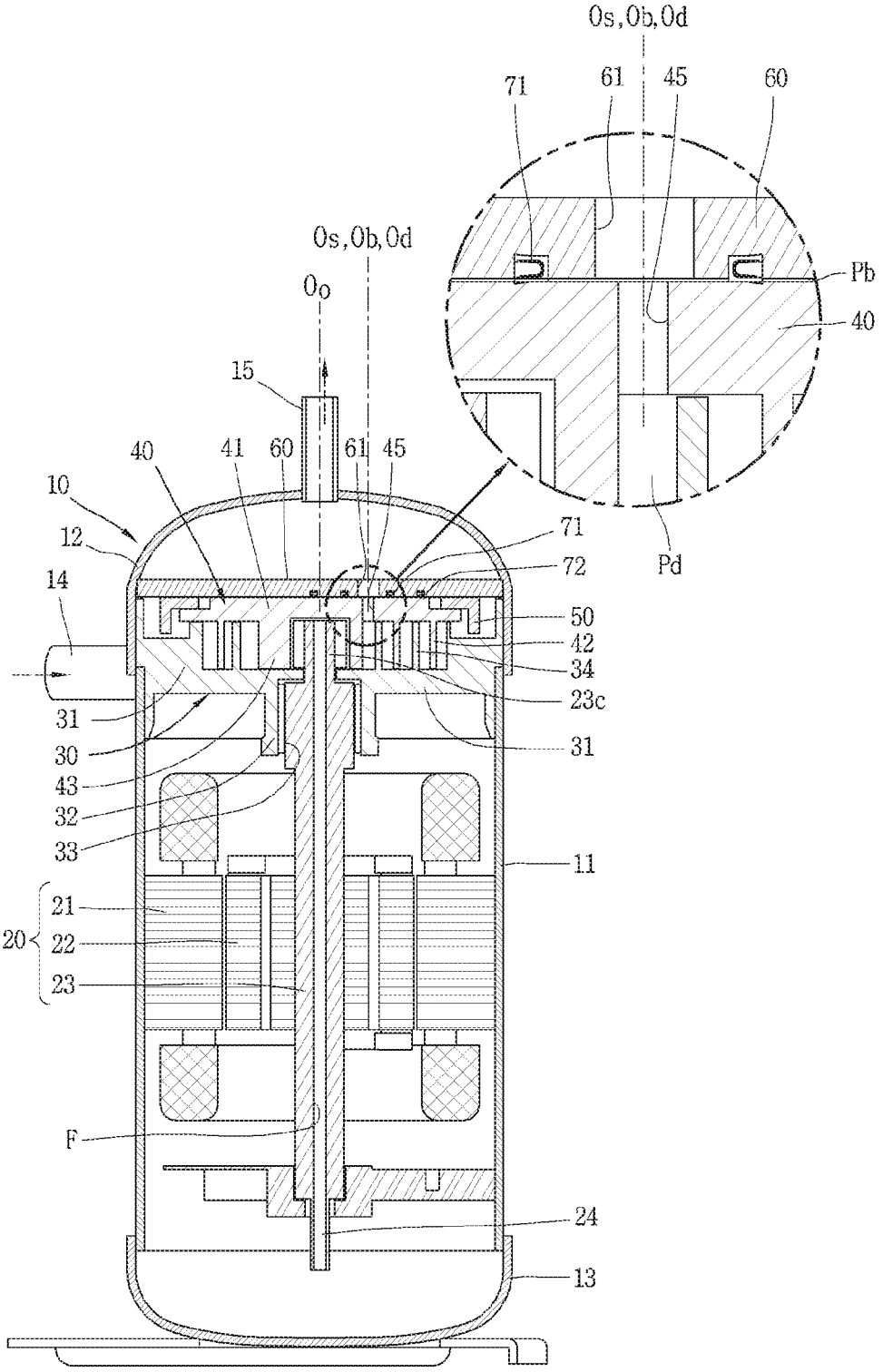
FIG. 3 is a longitudinal sectional view of a scroll compressor according to an embodiment as broadly described herein.
Figure 4:
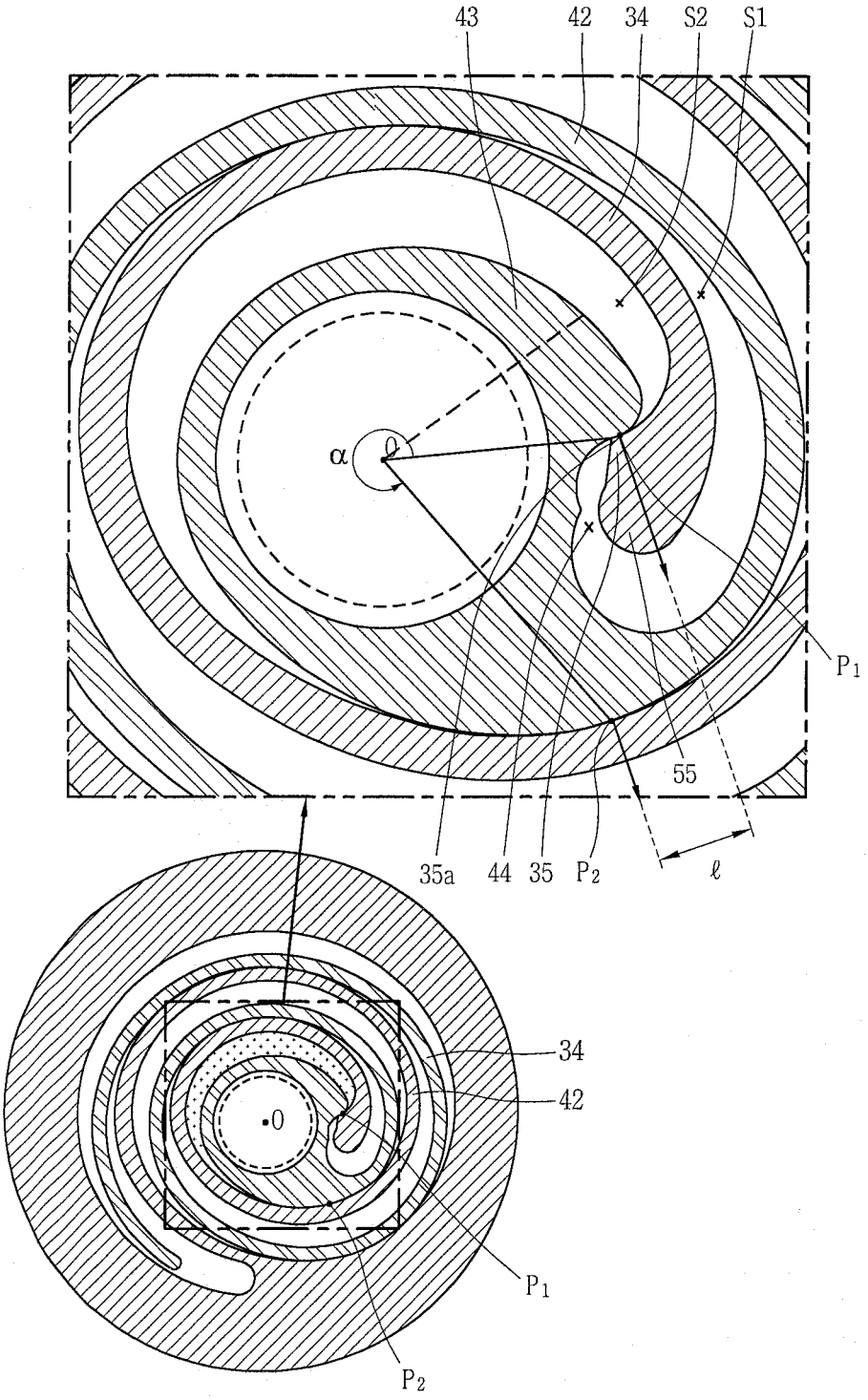
FIG. 4 is a planar view illustrating a compression part of the scroll compressor shown in FIG. 3.
Figure 5:
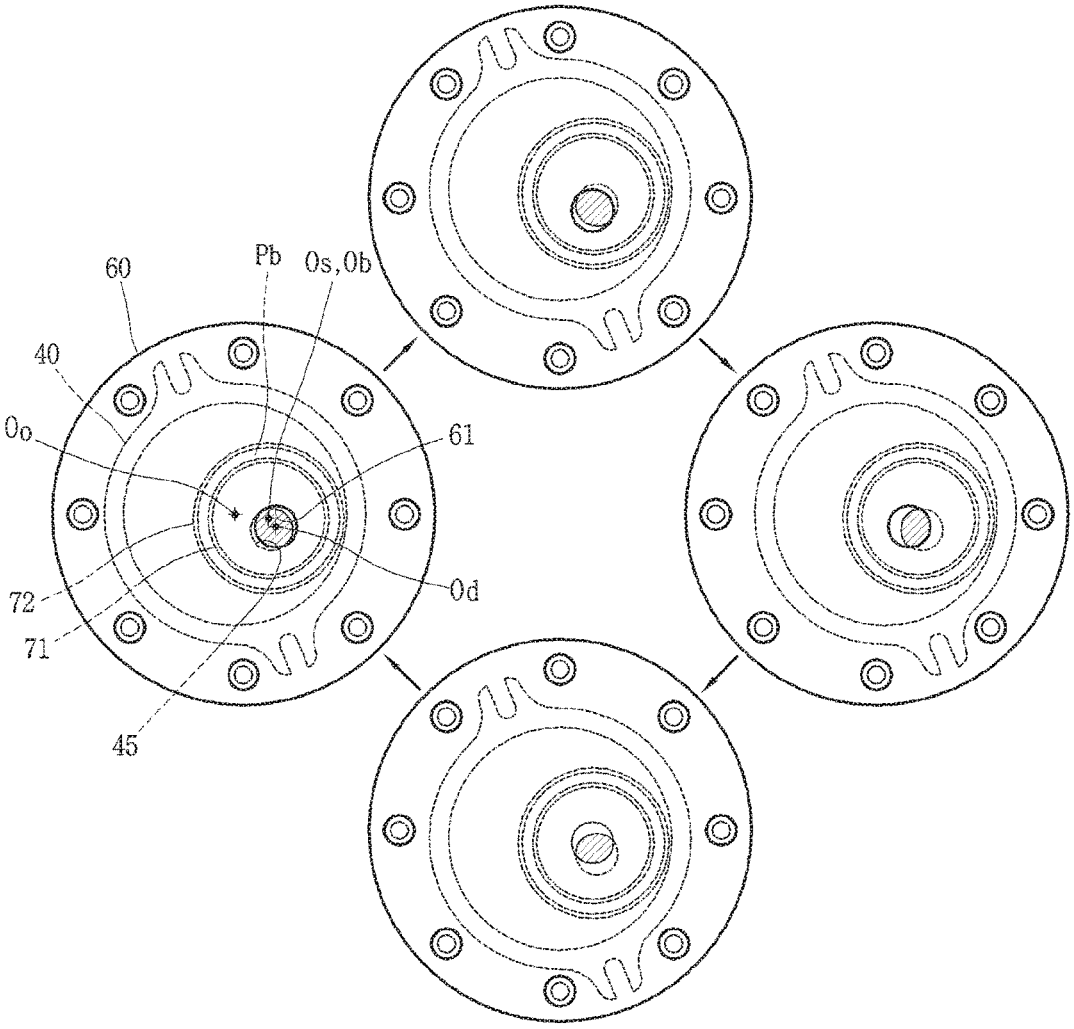
FIG. 5 is a planar view illustrating relative positions of a fixed side discharge opening and an orbiting side discharge opening, based on an orbital path of an orbiting scroll of the scroll compressor shown in FIG. 4.

As shown in FIGS. 3-5, a scroll compressor as embodied and broadly described herein may include a driving motor 20 installed in a hermetic container 10, and a fixed scroll 30 integrally formed with a main frame fixedly installed above the driving motor 20. An orbiting scroll 40, which is engaged with the fixed scroll 30 and is configured to compress a refrigerant while performing an orbiting motion through its coupling to a rotation shaft 23 of the driving motor 20, may be installed above the fixed scroll 30.

The hermetic container 10 may include a cylindrical casing 11, and an upper shell 12 coupled to an upper part of the casing 11, and a lower shell 13 coupled to a lower part of the casing 11, for example, by welding, so as to cover the upper part and the lower part of the casing 11. A suction pipe 14 may be installed on a side surface of the casing 10, and a discharge pipe 15 may be installed above the upper shell 12. The lower shell 13 may also serve as an oil chamber for storing therein oil to be supplied to the compressor for smooth operation of the compressor.

The driving motor 20 may include a stator 21 fixed to an inner surface of the casing 10, and a rotor 22 positioned in the stator 21 and rotating by a reciprocal operation with the stator 22. A rotation shaft 23, which rotates together with the rotor 22, may be coupled to a central part of the rotor 22.

An oil passage (F) may penetrate a central region of the rotation shaft 23, in a lengthwise direction. An oil pump 24, configured to pump oil stored in the lower shell 13, may be installed at a lower end of the rotation shaft 23. A pin portion 23*c* may be formed at an upper end of the rotation shaft 23, in an eccentric manner from the center of the rotation shaft 23.

The fixed scroll 30 may be fixed as its outer circumferential surface to the container 10, forcibly-inserted between the casing 11 and the upper shell 12 by shrinkage fitting. Alternatively, the fixed scroll 30 may be coupled to the casing 11 and the upper shell 12 by welding.

A boss 32 may be formed at a central region of a plate 31 of the fixed scroll 30. A shaft accommodating hole 33, configured to accommodate the rotation shaft 23 in a penetrating manner, may be formed at the boss 32. A fixed wrap 34 may be formed on an upper surface of the plate 31 of the fixed scroll 30. The fixed wrap 34 is engaged with an orbital wrap 42 of the orbiting scroll 40, and forms a first compression chamber (S1) on an outer side surface of the orbital wrap 42 and a second compression chamber (S2) on an inner side surface of the orbital wrap 42.

The orbiting scroll 40 may be supported at an upper surface of the fixed scroll 30. The orbiting scroll 40 may include a plate 41 formed in a substantially circular shape, and the orbital wrap 42 formed on an upper surface of the plate 41. The orbital wrap 42 forms a pair of compression chambers S1 and S2 which move consecutively, through engagement with the fixed wrap 34. Each of the compression chambers S1 and S2 may include a suction chamber, an intermediate pressure chamber and a discharge chamber (Pd). A rotation shaft coupling portion 43, which has a substantially circular shape and to which the pin portion 23*c* of the rotation shaft 23 is rotatably insertion-coupled, may be formed at a central region of the plate 41.

The pin portion 23*c* of the rotation shaft 23 may be insertion-coupled to the rotation shaft coupling portion 43. The pin portion 23*c* may be coupled to the rotation shaft coupling portion 43 of the orbiting scroll 40, through the plate 31 of the fixed scroll 30.

The orbital wrap 42, the fixed wrap 34 and the pin portion 23*c* may overlap one another, in a radial direction of the scroll compressor. During a compression operation of the scroll compressor, a repulsive force of a refrigerant is applied to the fixed wrap 34 and the orbital wrap 42. As a reaction force of the repulsive force, a compressive force is applied between the rotation shaft coupling portion 43 and the pin portion 23*c*. In the case where the pin portion 23*c* of the rotation shaft 23 overlaps the wrap in a radial direction through the plate 41 of the orbiting scroll 40, a repulsive force of a refrigerant and a compressive force are applied to the same side surface based on the plate 41 of the orbiting scroll 40. Therefore, the repulsive force and the compressive force may be attenuated from each other.

Each of the fixed wrap 34 and the orbital wrap 42 may be formed in an involute curve. However, in some cases, the fixed wrap 34 and the orbital wrap 42 may be formed in a shape other than an involute curve. Referring to FIG. 4, under an assumption that the center of the rotation shaft coupling portion 43 is 'O' and two contact points between the wraps 34 and 42 are 'P1' and 'P2', an angle ($\alpha$) defined by two straight lines, the straight lines formed by connecting the center 'O' of the rotation shaft coupling portion 43 to the two contact points 'P1' and 'P2', respectively, is less than 360°. Also, a distance (l) between a normal vector of the contact point 'P1' and a normal vector of the contact point 'P2 is larger than 0. Under such configuration, the scroll compressor may have an increased compression ratio, because it has a smaller volume than in a case in which the first compression chamber (S1) prior to discharge has the fixed wrap 34 and the orbital wrap 42 of an involute curve.

A protrusion 35, which protrudes toward the rotation shaft coupling portion 43, may be formed near an inner end portion of the fixed wrap 34. A contact portion 35*a* may be formed at the protrusion 35, protruding from the protrusion 35. Accordingly, the inner end portion of the fixed wrap 34 may have a larger thickness than other parts.

A concave portion 44, which is engaged with the protrusion 35, may be formed at the rotation shaft coupling portion 43. One side wall of the concave portion 44 may contact the contact portion 35*a* of the protrusion 35, thereby forming the contact point 'P1' of the first compression chamber (S1).

An upper frame 60, which supports a rear surface of the orbiting scroll 40 and an Oldham's ring 50, may be installed at an upper side of, or above, the orbiting scroll 40. Seals 71, 72 having a geometric center (Os), which support the orbiting scroll 40 by forming a back pressure chamber having a geometric center (Ob), may be installed between the rear surface of the orbiting scroll 40 and a bottom surface of the upper frame 60. A fixed side discharge opening 61, which is in communication with an orbiting side discharge opening 45 of the orbiting scroll 40, and through which a compressed refrigerant is discharged to the upper shell 12, may be formed at the upper frame 60.

The orbiting side discharge opening 45 may be formed near an outside of the rotation shaft coupling portion 43, so that a refrigerant compressed in the first compression chamber (S1) and the second compression chamber (S2) may be alternately discharged. The orbiting side discharge opening 45 may be formed so that a sectional area of an outlet is larger than that of an inlet. However, in a case in which the fixed side discharge opening 61 is formed to widely overlap the orbiting side discharge opening 45, the inlet and the outlet may have the same sectional area as shown in FIGS. 4 and 5.

The fixed side discharge opening 61 may be formed at the center of the upper frame 60, or near the center of the upper frame 60, so that its center may be almost consistent with, or aligned with, a geometrical center (Oo) of the orbiting scroll 40. In this case, flow resistance may occur because the orbiting side discharge opening 45 is bent or the orbiting side discharge opening 45 has a complicated flow path. Therefore, the fixed side discharge opening 61 may be formed in an eccentric manner toward the orbiting side discharge opening 45, so that the fixed side discharge opening 61 may overlap the orbiting side discharge opening 45 across a relatively wide area. In this case, a flow path of the orbiting side discharge opening 45 may be straight, and thus flow resistance may be reduced.

For instance, the fixed side discharge opening 61 may be formed at a position where at least part of the orbiting side discharge opening 45 may overlap the fixed side discharge opening 61 when the orbiting scroll 40 performs an orbital motion, i.e., a position where an axial center of the orbiting side discharge opening 45 is consistent with an axial or geometric center (Od) of the fixed side discharge opening 61 at least once.

An operation of the scroll compressor, as embodied and broadly described herein, follows. The rotation shaft 43 rotates as power is supplied to the driving motor 20, the orbiting scroll 40 eccentrically-coupled to the rotation shaft 23 performs an orbital motion along a prescribed path. And the compression chamber (P) formed between the orbiting scroll 40 and the fixed scroll 30 moves to the center of the orbital motion consecutively, to thus have a decreased volume. In the compression chamber (P), a refrigerant is sucked, compressed and discharged consecutively. Such processes are repeatedly performed.

Figure 6:
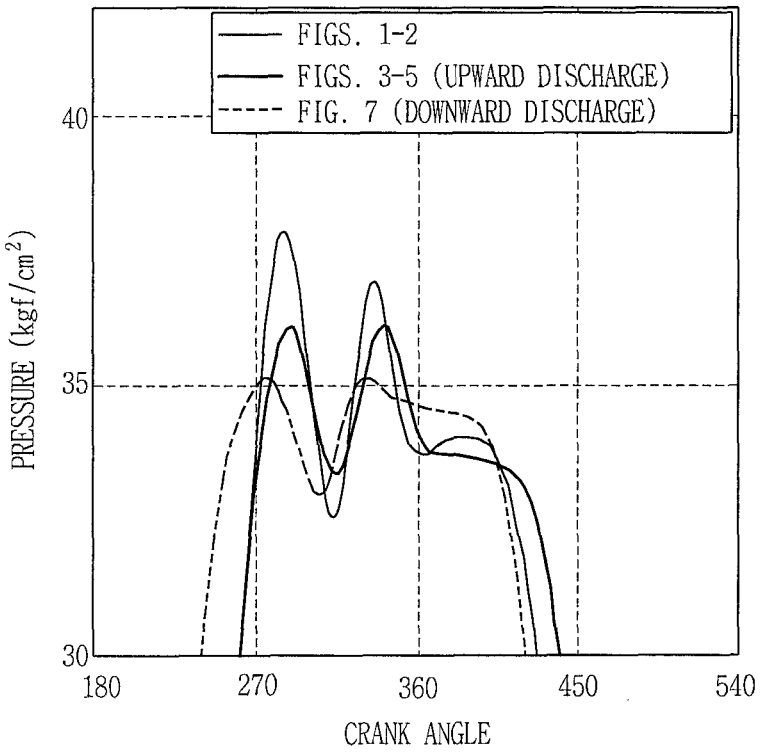
FIG. 6 is a graph comparing a pressure change with respect to a crank angle in the scroll compressor shown in FIG. 3 compared to other embodiments.

Over-compression may occur at the first compression chamber (S1) and the second compression chamber (S2). The orbiting side discharge opening 45 of the orbiting scroll 40 may not be formed at the geometrical center of the orbiting scroll 40 by the rotation shaft coupling portion 43, but may be formed outside the rotation shaft coupling portion 43 in an eccentric manner. On the other hand, the fixed side discharge opening 61 of the upper frame 60 may be formed to be almost consistent with the geometrical center of the orbiting scroll 40, with consideration of the seals 71, 72. In this case, a phenomenon in which pressure of the first compression chamber (S1) increases excessively as shown in FIG. 6 while flow resistance increases between the fixed side discharge opening 61 and the orbiting side discharge opening 45 because the fixed side discharge opening 61 and the orbiting side discharge opening 45 are eccentrically formed, a so-called 'over-compression' may occur. In this embodiment, to avoid over-compression, the fixed side discharge opening 61 is formed in an eccentric manner toward the orbiting side discharge opening 45 from the geometrical center (Oo) of the orbiting scroll 40, so that the fixed side discharge opening 61 may overlap the orbiting side discharge opening 45 across as relatively wide area. In this case, flow resistance between the orbiting side discharge opening 45 and the fixed side discharge opening 61 may be reduced. As a result, a refrigerant compressed in a final compression chamber may be rapidly discharged without being blocked by the upper frame 60, while maintaining a proper discharge pressure as shown in FIG. 6. Further, since the compression chambers S1 and S2 maintain a uniform pressure, input loss due to over-compression may be reduced.

Figure 7:
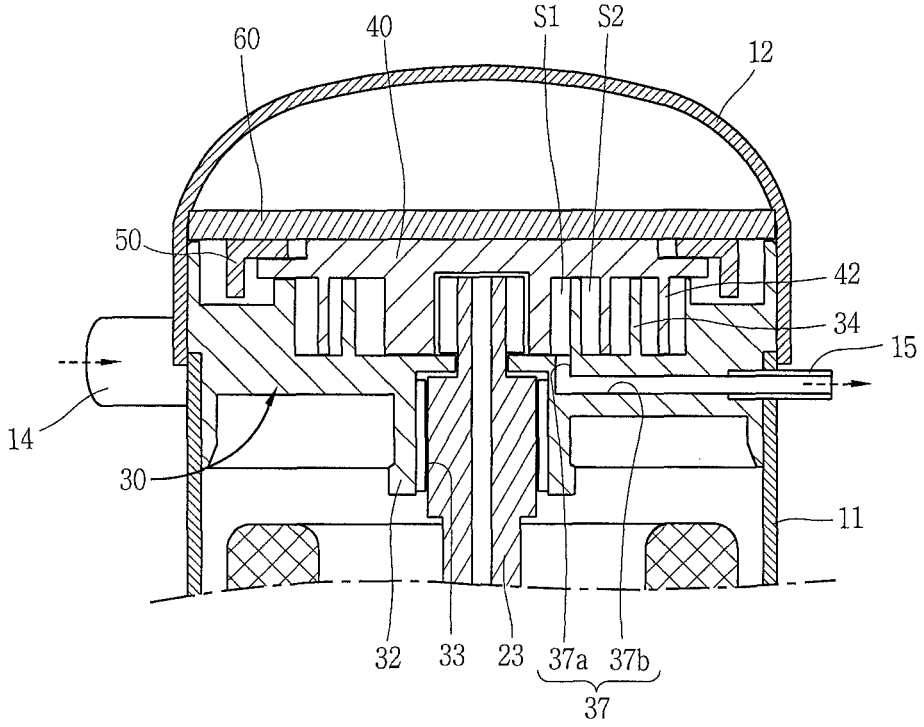
FIG. 7 is a longitudinal sectional view of a discharge opening of a scroll compressor, according to embodiments as broadly described herein.

A scroll compressor according to another embodiment will be explained with reference to FIG. 7.

In the aforementioned embodiment, the orbiting side discharge opening is formed at the orbiting scroll, and the fixed side discharge opening is formed at the upper frame. In this case, the fixed side discharge opening is formed in an eccentric manner toward the orbiting side discharge opening from the geometrical center of the orbiting scroll, so that the fixed side discharge opening may approach the orbiting side discharge opening. On the other hand, in the embodiment shown in FIG. 7, a discharge opening 37 is formed at the fixed scroll 30.

In this case, the discharge opening 37 may be penetratingly-formed from a bottom surface to an outer circumferential surface of the plate 31 of the fixed scroll 30, the plate 31 contacting the orbital wrap 42 of the orbiting scroll 40. The discharge opening 37 may have the same shape and size from its inlet to its outlet. For convenience in processing, a first discharge flow path 37*a* from the inlet to a vertical end, and a second discharge flow path 37*b* from the outlet to a horizontal end may have different shapes, according to the shape of the discharge opening 37.

A discharge pipe 15, which is penetratingly-formed at the casing 11, may be directly connected to the outlet of the discharge opening 37. In this case, a suction opening may communicate with inside of the hermetic container 10 with which the suction pipe 14 is communicated.

Even in the case where the discharge opening 37 is formed at the fixed scroll 30, a discharge flow path of a refrigerant discharged from the compression chamber may be simplified, and thus flow resistance may be reduced. As a result, the two compression chambers S1 and S2 may maintain a uniform pressure as shown in FIG. 6. Further, lowering of compression efficiency due to over-compression may be prevented.

A scroll compressor is provided that is capable of reducing a lowering in compression efficiency due to over-compression, by reducing flow resistance with respect to a refrigerant discharged from a compression chamber.

A scroll compressor, as embodied and broadly described herein, there is provided a scroll compressor, may include a hermetic container; a fixed scroll fixedly-coupled to the hermetic container, and having a fixed wrap; an orbiting scroll having an orbital wrap which forms a compression chamber by being engaged with the fixed wrap, and performing an orbital motion with respect to the fixed scroll; and a rotation shaft having an eccentric portion which is coupled to the orbiting scroll by passing through the fixed scroll, the eccentric portion overlapped with the orbital wrap in a radial direction, wherein an orbiting side discharge opening is formed at the orbiting scroll such that a refrigerant compressed in the compression chamber is discharged to inside of the hermetic container.

The orbiting side discharge opening may be formed near an inner end portion of the orbital wrap.

A frame configured to support the orbiting scroll may be provided on a rear surface of the orbiting scroll, and a fixed side discharge opening communicated with the orbiting side discharge opening may be formed at the frame.

The fixed side discharge opening may be formed so as to be always overlap with at least part of the orbiting side discharge opening, during an operation of the scroll compressor.

The fixed side discharge opening may be formed to be eccentric from a geometrical center of the frame.

The fixed side discharge opening may be formed to be eccentric from a geometrical center of the orbiting scroll.

The orbiting side discharge opening and the fixed side discharge opening may be formed such that centers thereof are consistent with each other at least once when the orbiting scroll performs an orbital motion.

A sealing member, configured to form a back pressure chamber between the orbiting scroll and the frame, may be installed on a rear surface of the orbiting scroll.

The orbiting side discharge opening may be penetratingly-formed at a tangential surface to the compression chamber in an axial direction, with the same inner diameter in a backward direction.

A scroll compressor, according to another embodiment, may include a pair of compression chambers each composed of a suction chamber, an intermediate pressure chamber and a discharge chamber from an outer side to an inner side, the compression chambers formed as a fixed scroll and an orbiting scroll perform an orbital motion with respect to each other by being engaged with each other, in a state where the orbiting scroll is disposed between the fixed scroll and a frame; a suction opening formed at the fixed scroll so as to be communicated with the suction chamber of the compression chamber; a first discharge opening formed at the orbiting scroll so as to be communicated with the discharge chamber of the compression chamber; a second discharge opening formed at the frame so as to be communicated with the first discharge opening, wherein the first discharge opening and the second discharge opening are formed at positions where at least parts thereof are always overlapped with each other.

The first discharge opening and the second discharge opening may be formed such that they are concentric with each other at least once when the orbiting scroll performs an orbital motion.

A rotation shaft coupling portion to which a rotation shaft is coupled may be formed at the orbiting scroll. The discharge opening may be formed out of a forming range of the rotation shaft coupling portion.

The second discharge opening may be formed to be eccentric from a geometrical center of the frame.

A back pressure chamber of a ring shape may be formed between the orbiting scroll and the frame, and the first discharge opening and the second discharge opening may be formed at an inner side of the back pressure chamber.

A scroll compressor, according to another embodiment, may include a hermetic container; a fixed scroll fixedly-coupled to the hermetic container, and having a fixed wrap; an orbiting scroll having an orbital wrap which forms a compression chamber by being engaged with the fixed wrap, and performing an orbital motion with respect to the fixed scroll; a frame configured to support a rear surface of the orbiting scroll such that the orbiting scroll is positioned between the frame and the fixed scroll; and a rotation shaft having an eccentric portion which is coupled to the orbiting scroll by passing through the fixed scroll, the eccentric portion overlapped with the orbital wrap in a radial direction, wherein a discharge opening through which a refrigerant compressed in the compression chamber is discharged is formed at the fixed scroll.

The discharge opening may be formed to be eccentric from the center of the rotation shaft.

The discharge opening may be penetratingly-formed at the fixed scroll so as to contact an inner circumferential surface of the hermetic container.

A discharge pipe may be connected to the discharge opening.

In a scroll compressor as embodied and broadly described herein, the fixed side discharge opening may be eccentric from a geometrical center of the orbiting scroll toward the orbiting side discharge opening, so as to overlap with the orbiting side discharge opening on a wide area. This may reduce flow resistance between the orbiting side discharge opening and the fixed side discharge opening. Accordingly, a refrigerant compressed in a final compression chamber may be rapidly discharged without being blocked by an upper frame, while maintaining a proper discharge pressure. Further, since compression chambers positioned at both sides of the scroll compressor have a uniform pressure, input loss due to over-compression may be reduced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a hermetic container that defines an inner space;

a fixed scroll provided in the inner space of the hermetic container, the fixed scroll having a fixed wrap;

an orbiting scroll provided in the inner space of the hermetic container, the orbiting scroll having an orbital wrap that is engaged with the fixed wrap of the fixed scroll so as to form a compression chamber therebetween as the orbiting scroll performs an orbital motion with respect to the fixed scroll;

a rotation shaft having an eccentric portion that extends through the fixed scroll and is coupled to a center of the orbiting scroll, wherein the eccentric portion radially overlaps the orbital wrap;

a frame provided in the inner space, at a second side of the orbiting scroll opposite to a first side on which the orbital wrap is formed, and configured to support the orbiting scroll;

an Oldham ring provided between the second side of the orbiting scroll and a surface of the frame facing the second side of the orbiting scroll;

an orbiting side discharge opening formed in the orbiting scroll to communicate with the compression chamber, a position of the orbiting side discharge opening being eccentric from a geometric center of the orbital scroll, and the orbiting side discharge opening guiding refrigerant compressed in the compression chamber into the inner space of the hermetic container;

a fixed side discharge opening formed in the frame, in communication with the orbiting side discharge opening formed in the orbiting scroll, a position of the fixed side discharge opening being eccentric from the geometric center of the orbital scroll and from a geometric center of the frame; and a seal provided on the second side of the orbiting scroll and configured to form a ring shaped back pressure chamber between the second side of the orbiting scroll and a surface of the frame facing the second side of the orbiting scroll, a geometric center of the seal being eccentric from the geometric center of the orbiting scroll such that a geometric center of the ring shaped back pressure chamber is eccentric from the geometric center of the orbiting scroll so as to be adjacent to a geometric center of the fixed side discharge opening rather than an axial center of the eccentric portion of the rotation shaft.

2. The scroll compressor of claim 1, wherein the orbiting side discharge opening is formed near an inner end portion of the orbital wrap.

3. The scroll compressor of claim 1, wherein the fixed side discharge opening is positioned so as to always overlap at least a portion of the orbiting side discharge opening during operation of the scroll compressor.

4. The scroll compressor of claim 3, wherein the orbiting side discharge opening and the fixed side discharge opening are formed such that respective centers thereof are aligned with each other at least once when the orbiting scroll performs the orbital motion with respect to the fixed scroll.

5. The scroll compressor of claim 1, wherein a surface of the orbiting scroll includes the orbiting side discharge opening, with an inner diameter of the orbiting side discharge opening being uniform along a length thereof.

6. A scroll compressor, comprising:

an orbiting scroll installed between a fixed scroll and a frame and having a first surface and a second surface opposite the first surface, and engaged with the fixed scroll so as to form at least one compression chamber therebetween, the at least one compression chamber including a discharge chamber that is eccentric from a geometric center of the orbiting scroll, wherein the orbiting scroll includes a rotation shaft coupling portion to which a rotation shaft is coupled;

an Oldham ring provided between the second surface of the orbiting scroll and a surface of the frame facing the second surface of the orbiting scroll;

a first discharge opening formed at the orbiting scroll, in communication with the discharge chamber wherein a position of the first discharge opening is outside of an area of the orbiting scroll where the rotation shaft coupling portion is formed;

a second discharge opening formed at the frame, in communication with the first discharge opening, wherein the first discharge opening and the second discharge opening are formed at positions such that the first discharge opening and the second discharge opening always at least partially overlap each other; and at least one seal provided on the second surface of the orbiting scroll and configured to form a ring-shaped back pressure chamber between the second surface of the orbiting scroll and the surface of the frame facing the second surface of the orbiting scroll, wherein the first discharge opening and the second discharge opening are formed at an inner side of the back pressure chamber, wherein a position of the second discharge opening is eccentric from a geometric center of the frame, and wherein a geometric center of the at least one seal is eccentric from the geometric center of the orbiting scroll such that a geometric center of the ring shaped back pressure chamber is eccentric from the geometric center of the orbiting scroll so as to be adjacent to a geometric center of the discharge chamber rather than the geometric center of the orbiting scroll.

7. The scroll compressor of claim 6, wherein the first discharge opening and the second discharge opening are formed so as to be concentric with each other at least once when the orbiting scroll performs the orbital motion.

* * * * *